US008020621B2

(12) United States Patent
DiFoggio et al.

(10) Patent No.: US 8,020,621 B2
(45) Date of Patent: Sep. 20, 2011

(54) DOWNHOLE APPLICATIONS OF COMPOSITES HAVING ALIGNED NANOTUBES FOR HEAT TRANSPORT

(75) Inventors: Rocco DiFoggio, Houston, TX (US); Roger Fincher, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 316 days.

(21) Appl. No.: 11/833,015

(22) Filed: Aug. 2, 2007

(65) Prior Publication Data

US 2009/0032259 A1 Feb. 5, 2009

Related U.S. Application Data

(63) Continuation-in-part of application No. 11/745,735, filed on May 8, 2007.

(51) Int. Cl.
*E21B 43/24* (2006.01)
*E21B 36/00* (2006.01)

(52) U.S. Cl. ..... 166/302; 166/57

(58) Field of Classification Search ..... 166/302, 166/57

See application file for complete search history.

(56) References Cited

U.S. PATENT DOCUMENTS

| | | | | |
|---|---|---|---|---|
| 4,375,157 | A | 3/1983 | Boesen | |
| 5,720,342 | A * | 2/1998 | Owens et al. | 166/57 |
| 5,931,000 | A | 8/1999 | Turner et al. | |
| 2002/0104328 | A1 | 8/2002 | DiFoggio | |
| 2002/0197923 | A1 | 12/2002 | Tobita et al. | |
| 2003/0085039 | A1 | 5/2003 | DiFoggio | |
| 2003/0096104 | A1 * | 5/2003 | Tobita et al. | 428/332 |
| 2003/0117770 | A1 * | 6/2003 | Montgomery et al. | 361/687 |
| 2004/0034346 | A1 | 2/2004 | Stern et al. | |
| 2004/0097635 | A1 * | 5/2004 | Fan et al. | 524/496 |
| 2004/0112601 | A1 | 6/2004 | Hache | |
| 2004/0261987 | A1 * | 12/2004 | Zhang et al. | 165/183 |
| 2005/0006754 | A1 | 1/2005 | Arik et al. | |
| 2005/0224220 | A1 * | 10/2005 | Li et al. | 165/185 |
| 2005/0260412 | A1 | 11/2005 | Gardner | |
| 2006/0086506 | A1 * | 4/2006 | Golla et al. | 166/302 |
| 2006/0101831 | A1 | 5/2006 | Storm et al. | |
| 2006/0102353 | A1 | 5/2006 | Storm et al. | |
| 2006/0162931 | A1 | 7/2006 | Mayes | |

(Continued)

FOREIGN PATENT DOCUMENTS

EP 1533467 A2 5/2005

(Continued)

OTHER PUBLICATIONS

Thermal Conduit Based on Aligned Nanocomposites; RCI Formation Evaluation.

(Continued)

*Primary Examiner* — Giovanna Wright
(74) *Attorney, Agent, or Firm* — Cantor Colburn LLP

(57) ABSTRACT

In one aspect, an apparatus is disclosed that includes an anisotropic nanocomposite element in thermal communication with a heat-generating element for conducting heat away from the heat-generating element along a selected direction. In another aspect, a method of conveying heat away from a heat-generating element is disclosed that includes transferring heat from the heat-generating element to an anisotropic nanocomposite element that is configured to conduct heat along a selected direction, and transferring heat received by the anisotropic nanocomposite element to a heat-absorbing element.

14 Claims, 3 Drawing Sheets

U.S. PATENT DOCUMENTS

| | | | | |
|---|---|---|---|---|
| 2006/0191682 | A1* | 8/2006 | Storm et al. | 166/250.01 |
| 2006/0213660 | A1 | 9/2006 | DiFoggio et al. | |
| 2006/0255450 | A1* | 11/2006 | Pan et al. | 257/712 |
| 2007/0006583 | A1* | 1/2007 | Veneruso | 60/508 |
| 2007/0066491 | A1 | 3/2007 | Bicerano et al. | |
| 2007/0151591 | A1 | 7/2007 | Jeffryes | |
| 2008/0174963 | A1* | 7/2008 | Chang et al. | 361/700 |
| 2008/0277162 | A1* | 11/2008 | DiFoggio | 175/17 |

FOREIGN PATENT DOCUMENTS

| | | | |
|---|---|---|---|
| EP | 1533468 | A1 | 5/2005 |
| EP | 1533469 | A1 | 5/2005 |
| JP | 11046021 | A1 | 2/1999 |

OTHER PUBLICATIONS

Anistropic Thermal Conductivity in Carbon Nanotube Reinforced Ceramic Nanocomposites; UC Davis Innovation Access; www.research.ucdavis.edu/ncd.cfm?ncdid=691.

Synopsis: Magnetically Aligning SWNTs for High Performance, Multifunctional Nanomaterials; FAMU-FSU College of Engineering, Florida Advanced Center for Composite Technologies; www.fac2t.eng.fsu.edu.

New Study Shows Nanotubes Have Foam Like Properties, Flexing and Rebounding With Great Compressibility; Dec. 6, 2005; Jennifer Rocha.

Nanostructures and Energy Conversion; M. S. Dresselhaus; Department of Electrical Engineering and Computer Science, Massachusetts Institute of Technology, Cambridge, MA; Proceedings of 2003 Rohsenow Symposium on Future Trends of Heath Transfer, May 16, 2003.

Mechanical Properties of Carbon Nanoparticle-Reinforces Elastomers; Mark D. Frogley, Diana Ravich , H. Daniel Wagner; Department of Materials and Interfaces, Weizmann Institute of Science, Rehovot, Israel.

Nematic Elastomers With Aligned Carbon Nano-Tubes: New Electromechanical Actuators; S. Courty, J. Mine, A. R. Tajbakshs and E. M. Terentjev; Cavendish Laboratory, University of Cambridge, Cambridge, UK; Europhysics Letters, 64(5), pp. 654-660 (2003).

Magnetically Aligned Single Wall Carbon Nanotube Films: Preferred Orientation and Anisotropic Transport Properties; J. E. Fischer, W. Zhou, J. Vavro, M. C. Llaguno, C. Guthy, R. Haggenmuster; 2003 American Institute of Physics; Journal of Applied Physics vol. 93, No. 4.

Li et al.; "Thermal Diode: Rectification of Heat Flux," The American Physical Society, vol. 93, No. 18, Physical Review Letters, Oct. 29, 2004, pp. 184301-1-184301-4.

Casati et al.; "Heat conduction in one dimensional systems: Fourier law, chaos, and heat control," The American Physical Society, Feb. 23, 2005, pp. 1-15.

Gendelman et al.; "Heat Conduction in a One-Dimensional Chain of Hard Disks with Substrate Potential," vol. 92, No. 7, The American Physical Society, Physical Review Letters, Feb. 20, 2004, pp. 074301-1-074301-4.

Hu et al.; "Heat conduction in one-dimensional Yukawa chains," The American Physical Society, Dec. 2, 2003, pp. 1-5.

Jones et al.; "Differential expansion thermal rectifier," Journal of Physics E:Scientific Instruments, 1971, vol. 4,, pp. 438-440.

Chang et al.; "Solid-State Thermal Rectifier," Science, vol. 314, No. 5802, Nov. 17, 2006, pp. 1121-1124.

O'Callaghan et al.; "A thermal rectifier," Journal of Physics D: Applied Physics, vol. 3, 1970, pp. 1352-1358.

Savin et al.; "Heat conduction in one-dimensional lattices with on-site potential," The American Physical Society, Physical Review E 67, (2003), pp. 041205-1-041205-12.

Service; "Physics: Electronic Nuisance Changes Its Ways," Science, vol. 314, No. 5802, Nov. 17, 2006, pp. 1065-1067.

Segal et al.; "Spin-Boson Thermal Rectifier," The American Physical Society, PRL 94, 034301 (2005), Physical Review Letters, Jan. 28, 2005, pp. 034301-1-034301-4.

Li et al.; "Anomalous heat conduction and anomalous diffusion in nonlinear lattices, single walled nanotubes, and billiard gas channels," The American Physical Society, Oct. 14, 2004, pp. 1-15.

Carbon Materials, Carbon Nanotube Composite Materials, University of Kentucky Center for Applied Energy Research, http://www.caer.uky.edu, 1 sheet.

Thostenson et al.; "Aligned multi-walled carbon nanotube-reinforced composites: processing and mechanical characterization," Institute of Physics Publishing, Journal of Physics D: Applied Physics, vol. 35, (2002) pp. L77-L80.

Patel; "A First: Directing Heat in Solids," Technology Review, Published by MIT, Nov. 22, 2006, http://www.technologyreview.com/, pp. 1-3.

* cited by examiner

DOWNHOLE APPLICATIONS OF COMPOSITES HAVING ALIGNED NANOTUBES FOR HEAT TRANSPORT

CROSS-REFERENCE TO RELATED APPLICATION

This application is a continuation-in-part of U.S. patent application Ser. No. 11/745,735 filed on May 8, 2007.

BACKGROUND OF THE DISCLOSURE

1. Field of the Disclosure

The disclosure relates to transferring heat from heat-generating elements in downhole applications.

2. Description of the Prior Art

Oil and gas are recovered from subterranean geological formations by means of oil wells or wellbores drilled through one or more oil producing formation. A variety of tools are used during the drilling of the wellbore and prior to the completion of a wellbore to provide information about various parameters relating to the formations surrounding the wellbore. These tools typically include a variety of sensors, electrical and electronic components, and other devices that can generate heat while in operation. The wellbore temperatures can vary from ambient to above 500° F. (about 260° C.) and pressures from atmospheric to above 20,000 psi (about 137.8 mega pascals). Temperature and pressure conditions such as these can have an adverse effect on instruments used downhole. Heat especially can be undesirable for tools having electronic components. In some instances, excess heat can cause electronic components to work more slowly or even fail. Therefore, it is desirable to maintain certain components of the downhole tools to desired temperature or to transfer heat-away from such components.

The disclosure herein provides an apparatus and method for transferring heat away from certain components in downhole tools.

SUMMARY OF THE DISCLOSURE

In one aspect, an apparatus is disclosed that includes an anisotropic nanocomposite element in thermal communication with a heat-generating element for conducting heat away from the heat-generating element along a selected direction.

In another aspect, a method of conveying heat away from a heat-generating element is disclosed that includes transferring heat from the heat-generating element to an anisotropic nanocomposite element that is configured to conduct heat along a selected direction, and transferring heat received by the anisotropic nanocomposite element to a heat-absorbing element.

In still another aspect, a tool for use in a wellbore is disclosed that includes a tool body that contains therein a heat-generating element, a heat conduction device that includes at least one anisotropic nanocomposite element coupled to the heat generating element for conducting heat away from the heat-generating element along a selected direction, and a heat absorbing element coupled to the heat conduction device for absorbing heat from the anisotropic nanocomposite element.

Examples of the more important features of a system for monitoring and controlling production from wells have been summarized rather broadly in order that the detailed description thereof that follows may be better understood, and in order that the contributions to the art may be appreciated.

There are, of course, additional features that will be described hereinafter and which will form the subject of the claims.

BRIEF DESCRIPTION OF THE DRAWINGS

The disclosure is best understood with reference to the accompanying figures in which like numerals generally refer to like elements, and in which.

DETAILED DESCRIPTION

Figure 1:
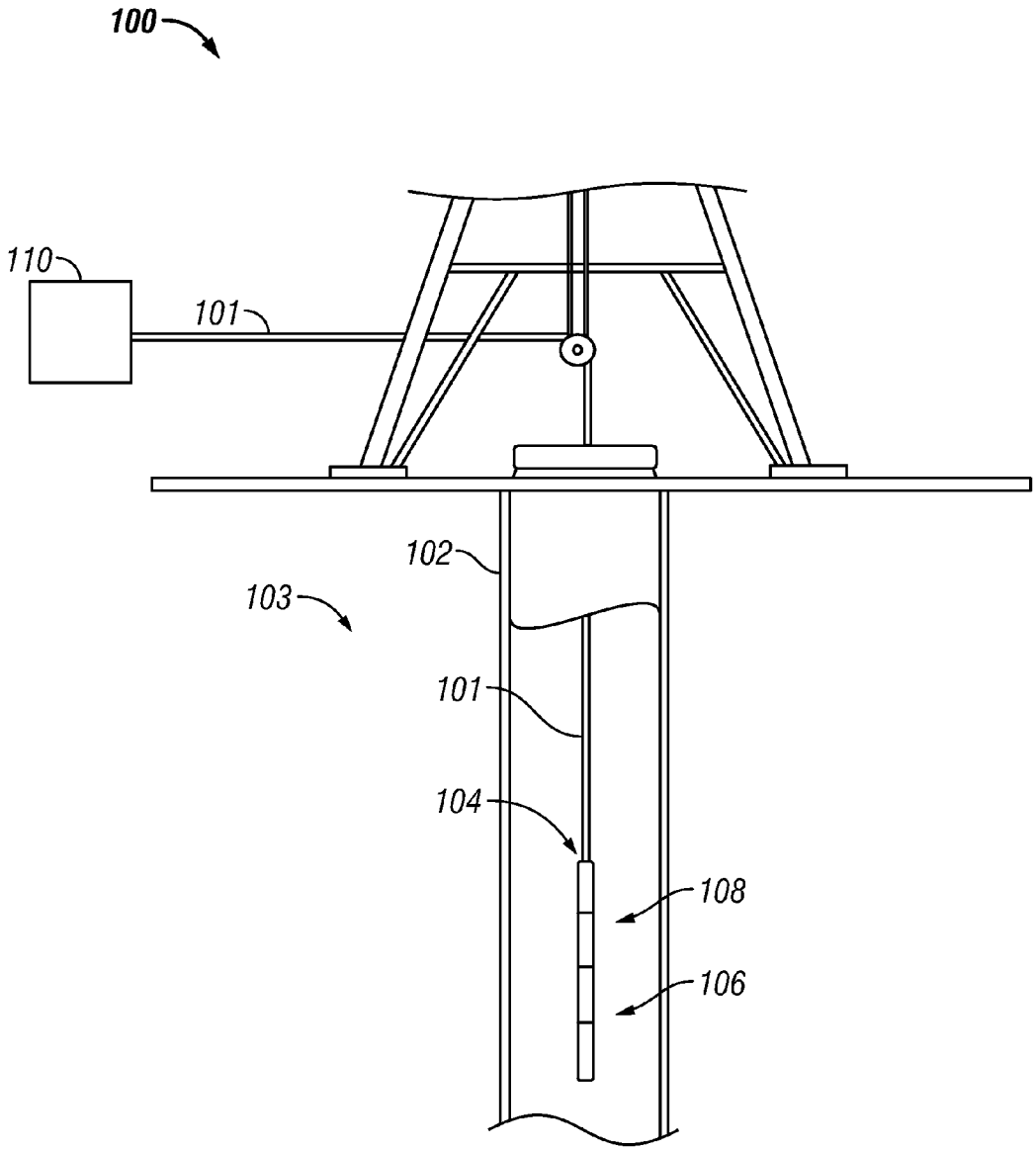
FIG. 1 is an illustration of an oil well having a downhole tool suspended from a wireline.

FIG. 1 is a schematic illustration of a well logging system that shows a downhole tool 104 conveyed in a wellbore 102 by a wireline 101. The wellbore is shown penetrating through a geological formation 103. The tool 104 includes one or more sensors 106 for estimating a parameter of interest of the wellbore and/or the formation 103. The tool 104 includes a control unit 108 that may include a processor, data storage medium, programs and models that are used by the processor to control the operation of the tool 104 and to process the data and signals. The control unit 108 is in data communication with a surface control unit 110, which may be a computer-based system that provides instructions to the control unit 108, receives data from the control unit 108 and processes the received data to estimate one or more properties of the wellbore 102 and/or the formation 103. Alternatively, the tool 104 may be conveyed in the wellbore via a slick line or any other suitable conveying member. The tool 104 may be a drilling 104 may be a single tool or a combination of tools assembly that is conveyed in the well by a jointed tubular or a coiled-tubing. Also, tool arranged in any desired manner.

The tool 104 may include any tool for performing an operation in the wellbore 102, including but not limited to a resistivity tool, nuclear tool, nuclear magnetic resonance tool, formation testing tool, and an acoustic tool. Additionally, the tool may be made up of a combination of these and other tools. Each of these tools may include a variety of electronic components, such as microprocessors and electrical components, such as motors, pumps, coils, transformers, etc. that generate heat during operation of the tool in the wellbore, which typically is at an elevated temperature, which in some cases may exceed 200 degrees Celsius. The temperature of the heat-generating elements, in some cases, may be several degrees higher than the temperature of the wellbore. Certain exemplary heat-transfer systems and methods for transferring heat from such heat-generating elements are described in reference to FIGS. 2-5.

Figure 2:
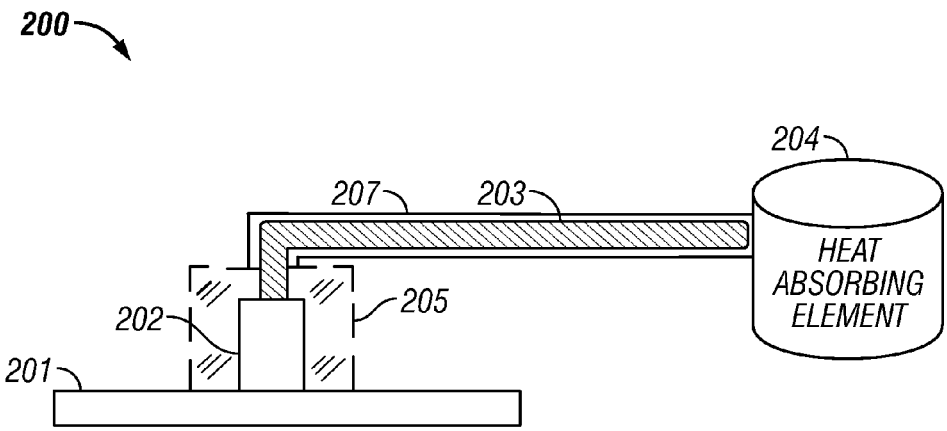
FIG. 2 is a schematic representation of a first embodiment of the disclosure including a heat generating element, a heat absorbing element, and a nanocomposite element

FIG. 2 is a schematic representation of an embodiment of a system 200 for transferring heat from a heat-generating element 202 to a heat-absorbing element 204. The heat-generating element 202 may be any device, component or a combination thereof that generates heat in the tool 102. The heat-generating element 202 is shown placed on a support member 201, which may be a metallic or non-metallic member. The heat-generating element 202, in one aspect, may be coupled to a heat-transfer element or member 203 for conducting heat away from the heat-generating element 202. In downhole tools, such as wireline tools and measurement-while-drilling tool, certain electronics components, such as microprocessors, sensors, motors, etc. can generate heat to cause these components to be several degrees Celsius (often 5 to 10 degrees Celsius) above their surrounding environment. The heat-transfer element 203 may be an anisotropic nanocomposite material or member in which heat-conductive nano particles, such as nano carbon tubes, are aligned or highly aligned in a selected direction (for example from the heat-generating element 202 to the heat-absorbing element 204). For the purposes of the disclosure, the term anisotropic means having properties that differ according to the direction of measurement. Stated another way, the nanocomposite element directionally conducts heat. For example, when the anisotropic element is in the form of a flat or round "cable," heat is conducted from one end of the cable towards the other end of the cable with relatively little or minimal heat being conducted through the sides or walls of the cable. For certain anisotropic nanocomposite elements, the ratio of thermal conductivity along one direction can be several times greater than the conductivity along a perpendicular direction, thereby effectively forming a heat conduit. If the matrix material of the anisotropic nanocomposite element is flexible, it can form a flexible heat conduit, wherein a substantial portion of the heat moves within the conduit rather than escaping through its walls. In this way, heat can be moved directionally away from the locale of the heat-generating elements, which may be near the thermal limit of their operation.

In the configuration of FIG. 2, heat will conduct from the heat-generating element 202 to the heat-absorbing element 204 via the anisotropic nano-composites element. A suitable insulating material or device 205 may be used to enclose the heat-generating element 202 to inhibit heat conduction from the heat-generating element 202 to other components in the tool 104 and/or to direct the heat toward the heat-conducting element 203. A protective material 207, such as in the form of one or more layers of any suitable material, may be used to enclose and protect the anisotropic nanocomposite element 203.

The heat-absorbing element 204 may be a heat-absorbing ceramic member placed in the tool or a portion of the tool 102, which remains at a temperature lower than that of the heat-generating element during operation of the tool. A metal housing surrounding the tool, drill collar of a drilling assembly that is in contact with circulating drilling fluid in the wellbore, a sorption cooler or a cryogenic device may be used as the heat sink 204. Wireline tool housings and drill collars carrying measurement-while-drilling tools can equilibrate to the temperature of the wellbore fluid after being in the wellbore. However, the electronics components, motors, sensors and the like inside the wireline tool or drill collar can raise the local internal temperature by 5 to 10 degrees centigrade, which temperature can sometimes exceed the operating temperature of such components. Therefore, for a wireline tool, certain metallic sections in the tool may be at a temperature lower than the heat-generating element. Similarly, the drill collar of a drilling assembly may remain colder than the heat-generating element because the temperature of the drilling fluid circulating around the drilling assembly is typically less than that of the heat-generating element. The heat sink 204 may be a passive heat sink, such as the drill collar, which is in contact with the wellbore fluid, a ceramic member and the like or it may be an active heat sink, such as a cryogenic device.

Figure 3:
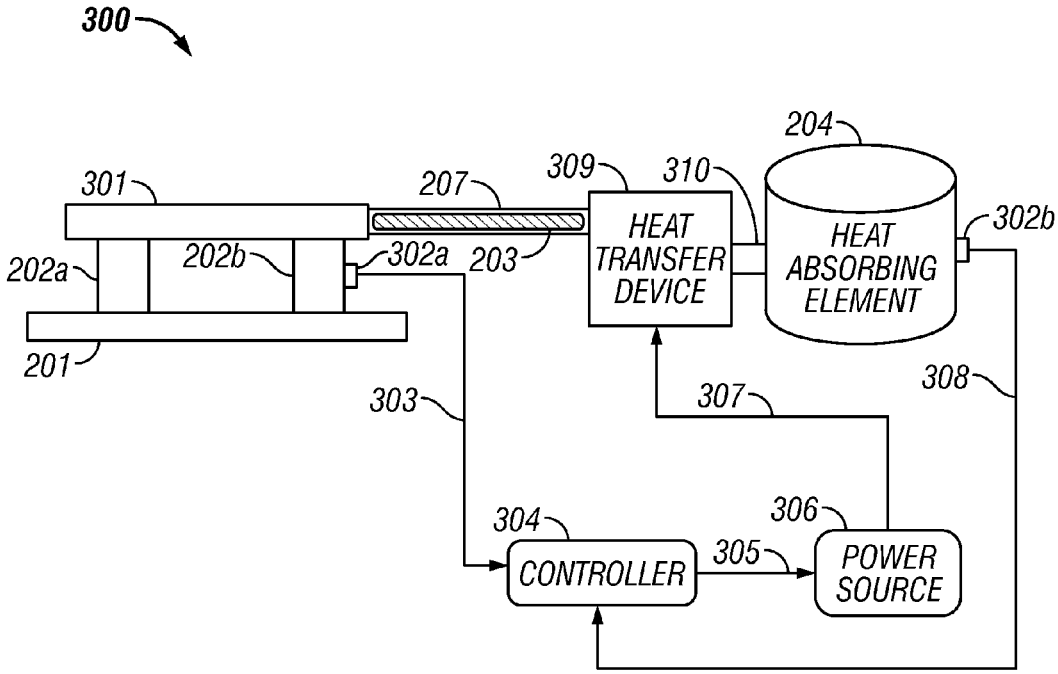
FIG. 3 is a schematic representation of a second embodiment of the disclosure further including a powered heat transfer device, a power source and a controller.

FIG. 3 is a schematic illustration of another embodiment of a heat transfer system 300 according to the present disclosure. System 300 is shown to include a pair of heat-generating elements 202*a* and 202*b* placed on a support member 201. The heat-generating elements 202*a* and 202*b* are in thermal communication with and conduct heat to a heat absorbing layer 301, which may be made from a nanocomposite material containing aligned carbon nanotubes or another suitable heat conducting material. The heat-conductive layer 301 is coupled to a heat transfer element 203, which moves the heat away from the heat-conductive layer 301. The heat transfer element 203 may be further coupled to an active heat transfer device 309 to pump or move heat from the heat conductive-element 203 to the heat absorbing element 204 via a heat-conductive element 310, which may be a nanocomposite material or another suitable heat-conductive material, such as an alloy. The heat transfer device 309 may be any active device that can move heat away from the heat-conductive element 203, including but not limited to a Peltier Cooler, a closed-loop heat transfer device or unit, a heat pump, including a heat pump that may employ a Joule-Thomson effect or sterling engine.

Still referring to FIG. 3, for controlling the operation of the heat-transfer device 309, a temperature sensor 302 coupled to the heat-generating element 202*a* or 202*b* or both may be used to measure the temperature at or proximate the heat-generating elements 202*a* and 202*b*. A temperature sensor 302*b* coupled to the heat-absorbing element 204 may be utilized to measure the temperature of the heat absorbing-element 204. A power source 306 supplies electrical power to the heat transfer device 309 via a power line 307. The power source 306 may be any suitable source, including, but not limited to, a battery in the tool 104, an electrical generator in the tool 104 or the power may be supplied via the wireline 101 to the tool 104. A controller 304, coupled to the power source 306 via a line 305 and configured to receive signals or data from the sensor 302*a* via a line 303 and sensor 203*b* via a line 308 may be utilized to control the operation of the heat transfer device 309. The lines 303, 305, 307 and 308 may be any suitable data and power conductors. The controller 304 may include a processor, such as microprocessor, a data storage medium, such as a solid-state memory, and programs stored in the data storage device that contain instructions for the controller 304 relating to the operation of the heat transfer system of FIG. 3.

In operation, in one aspect, the controller 304 monitors the temperatures of both the heat-generating elements 202*a* and/or 202*b* and the heat-absorbing element 302*b*. When the temperature of the heat-generating element reaches a preset value, the controller 304 sends a command to the power source to energize the heat transfer device. The controller 304, in accordance with the programmed instructions, maintains the heat transfer device 309 in an energized state until the temperature of the heat generating element falls below the preset temperature value or until the heat-absorbing element 204 reaches a temperature that is too high (a preset threshold value) for efficient heat transfer. At either of these two conditions, the heat transfer device can be de-energized thus allowing for energy conservation. In another aspect, the controller 304 may continuously or substantially continuously control or regulate the power to the heat-transfer device 309 to control the flow of heat from the heat-generating elements 202*a* and 202*b* to the heat-absorbing element 204, based on the temperatures of the heat-generating elements 202*a* and

202*b* and the heat-absorbing element 204. The temperature difference between the heat generating element 202*a* and/or 202*b* and the heat-absorbing element 204 may be used as a criterion for controlling the power to the heat transfer device 309.

Figure 4:
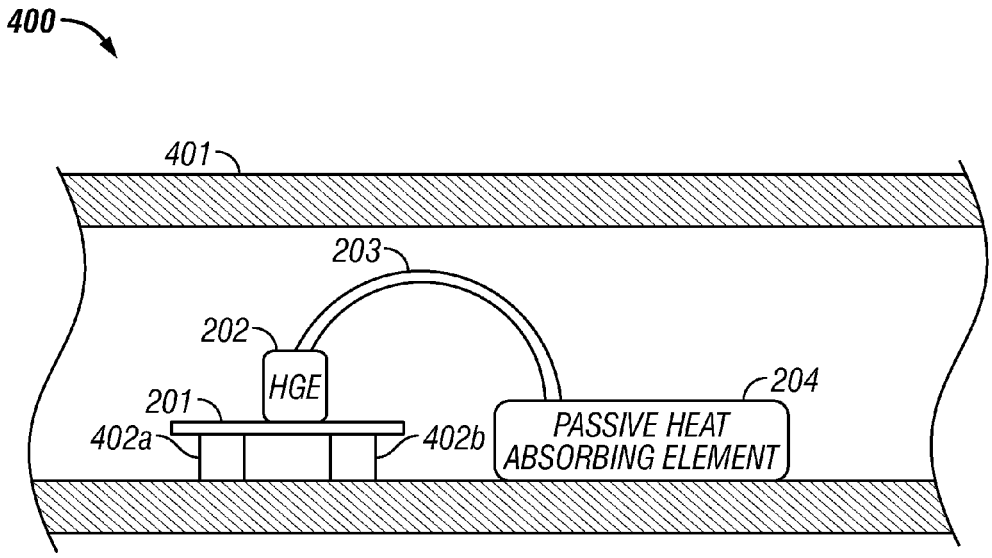
FIG. 4 is a schematic representation of part of a downhole tool showing an embodiment of the disclosure wherein heat from heat generating element is transferred to a heat absorbing element by means of a nanocomposite.

FIG. 4 is a schematic representation of part of a downhole tool showing an embodiment of a heat-transfer system 400 according to one aspect of the disclosure, wherein heat from the heat-generating element 202 is transferred to a heat-absorbing element 204 via a an anisotropic nanocomposite element 203, which in turn transfers the heat to a housing 401 of the tool 104. In this configuration, the heat-absorbing element 204 may be coupled or affixed to the housing by manner that efficiently dissipate heat from the heat absorbing element 204 to the tool housing 401. Although, the support members 402*a* and 402*b* are shown placed on the tool housing 401, the support members may be placed at any other suitable location. Also, the nanocomposite element 203 may be a rigid or non-rigid (flexible or semi-flexible) non-straight (a curved or another non-linear shape) member.

Figure 5:
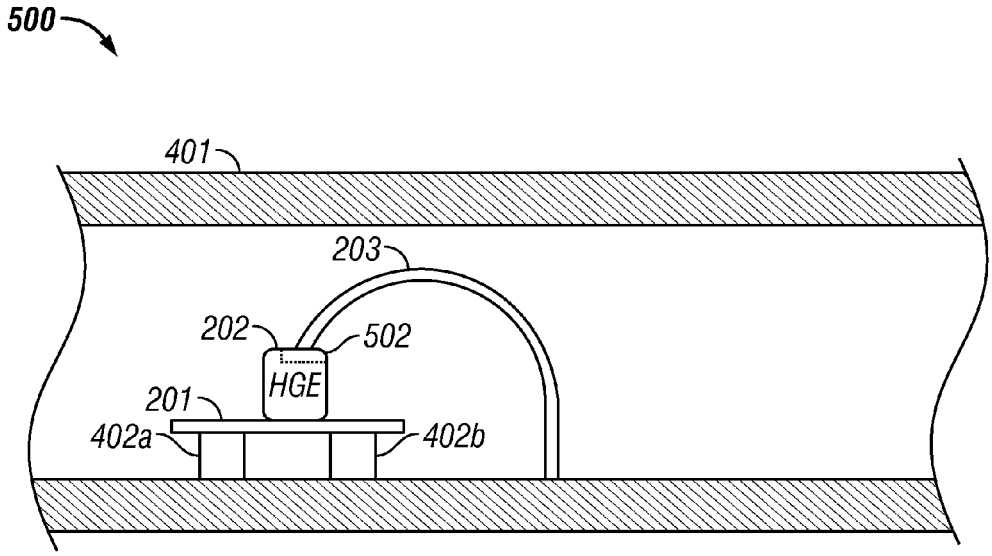
FIG. 5 is a schematic representation of a similar embodiment to FIG. 4 except that the tool casing or chassis functions as the heat absorbing element.

FIG. 5 is a schematic representation of an embodiment of a heat transfer system 500 that is similar to the embodiment of FIG. 4 except that the tool housing 401 functions as the heat absorbing element. In such a configuration, the heat-conducting element 203 may be directly coupled to the housing 401. The diagram also includes an interface 502 between the heat-conducting element 203 and heat-generating element 202.

In the heat-transfer systems and methods described herein, the anisotropic nanocomposite element may include a base material and aligned or highly-aligned thermally-conductive nano elements, such as nanotubes. The base material may be selected based on the temperature of the end use apparatus and the particular techniques employed to fluidize and solidify the base material. Examples of suitable base materials include polymers, ceramics, glasses, metals, alloys, and other composites. The base material also may be amorphous or crystalline. The base material may further include one or more additives. Examples include as binding agents, surfactants, and wetting agents to aid in dispersing and aligning the nanotubes in the base material.

In some embodiments, the base material used to prepare the nanocomposite element may polymeric. That is, it comprises one or more oligomers, polymers, copolymers, or blends thereof. In one such embodiment, the base material may include a thermoplastic polymer. In another such embodiment, the base material may include a thermoset polymer, such as phenol formaldehyde resins and urea formaldehyde resins. Examples of polymers suitable for use with the apparatus and method of the disclosure include, but are not limited to: polyolefins, polyesters, nonpeptide polyamines, polyamides, polycarbonates, polyalkenes, polyvinyl ethers, polyglycolides, cellulose ethers, polyvinyl halides, polyhydroxyalkanoates, polyanhydrides, polystyrenes, polyacrylates, polymethacrylates, polyurethanes, polyether ketones, polyether amides, polyether ether ketones, polysulfones, liquid crystal polymers and copolymers and blends thereof. In another aspect, the base material may include a polymer precursor or a crosslinkable material. As used herein, the term "polymer precursor" refers to monomers and macromers capable of being polymerized. As used herein, the term "crosslinkable material" refers to materials that can crosslink with themselves or with another material, upon heating or addition of a catalysts or other appropriate initiator. In one aspect, the polymer precursor may include an epoxy resin or a cyanoacrylate.

The nano elements may include any suitable thermally-conductive nano materials. In one aspect, the nano elements may be carbon nanotubes. The carbon nanotubes may be single-walled, which may be a wrapping of a one-atom-thick layer of graphite (such as grapheme) into a seamless cylinder. Such carbon nanotubes may have a diameter of about 1 nanometer (nm), with a tube length that may be substantially greater than the diameter, such as a length of few millimeters to 1.5 centimeters or longer. In another aspect, multiple-walled carbon nanotube may be utilized. A multi-walled nanotube comprises a graphite layer rolled to form a tube that has multiple layers. In addition, nanotubes useful for the disclosed apparatus and methods may be prepared using any material known to be useful for conducting. For example, the nanotubes may be prepared using boron nitride or gallium nitride.

The nanocomposite materials useful for the apparatus and methods of the disclosure are anisotropic due to the alignment of the nanotubes. For the purposes of this disclosure nano elements or tubes may be dispersed and aligned or highly-aligned by any method known for preparing such materials. For example, the nanotubes may be fixed with a magnetic element and then dispersed within a liquid or highly plastic base material. The base material may then be subjected to a magnetic field to align the nanotubes and then curing the base material to maintain the alignment of the nanotubes. In another method, the nanotubes may be aligned by extrusion through a very small aperture. In another method, the nanotubes may be aligned by encapsulating nanotubes of known orientation in a polymer by mechanically applying the nanotubes to a surface of a polymer to form a first material and then extruding a layer of the same or a different polymer around the first material to produce a fully encapsulated nanocomposite.

For the apparatus and methods of the disclosure, the nanocomposite material may be of any shape or configuration known to be useful. For example, the nanocomposite material may be in the shape of a cylinder or a rod with the nanotubes aligned to conduct temperature from one end toward the other end with minimal heat being conducted to the sides or walls of the cylinder or rod. In another aspect, the nanocompo site element may be a rectangular or curved sheet wherein heat is preferentially conducted along either the width or length of the sheet. In another aspect, the nanocomposite element may be in the form of a stack of such sheets. Also, the nanocomposite element may be rigid or it may be flexible so that it may be shaped in any desired form, such as shown in FIGS. 3-5 or that it may be placed around certain obstructions in the apparatus, etc.

Thus, in one embodiment, the disclosure provides an apparatus that includes an anisotropic nanocomposite element in thermal communication with a heat-generating element for conducting heat away from the heat-generating element along a selected direction. In one aspect, the anisotropic nanocomposite element contains highly-aligned thermally-conductive nano material, such as carbon nanotubes, to conduct substantially all of the heat in the direction of the alignment of the nano material. In one aspect, the apparatus may further include a heat-absorbing element placed in thermal communication with the anisotropic nanocomposite element for receiving heat from the anisotropic nanocomposite element. In another aspect, the apparatus may further include a heat-transfer device in thermal communication with the anisotropic nanocomposite element for transferring heat from the anisotropic nanocomposite element to the heat absorbing element. In another aspect, the apparatus may further include an interface element between the heat generating element and the anisotropic nanocomposite element for transferring heat from the heat conducting element to the anisotropic nanocomposite element. The nanocomposite element may include a base material and aligned thermally-conductive nanotubes. The nanotubes may be made from, carbon, boron nitride or gallium nitride. Further the nanocomposite element may be made using a stack of sheets, each sheet containing a base material and aligned thermally-conductive nanotubes. The heat-absorbing element may be any suitable member or device, including a metallic member, ceramic member, laminate of a metallic or ceramic or their combination, metal and non-metal composite, fluid, sorption cooler or a phase change device. Also, the heat-transfer element may be any active heat transfer device, including a Peltier cooler, closed-loop cooling unit, or heat pump that employs a Joule-Thompson effect or Stirling Engine. The apparatus, in one aspect, may also include a controller that controls the heat-transfer device in response to a temperature measurement of the heat-generating element or the heat-absorbing element. The controller may control power to the heat transfer device to control the transfer of heat away from the heat-generating element. The apparatus may further include an insulating element proximate to the heat-generating element for directing heat from the heat generating element toward the anisotropic nanocomposite element.

The disclosure in another aspect provides a method for conducting heat away from an element that includes the features of transferring heat from the heat-generating element to an anisotropic nanocomposite element that is configured to conduct heat along a selected direction and transferring heat from the anisotropic nanocomposite element to a heat-absorbing element. The method may further include transferring heat from the anisotropic nanocomposite element to the heat-absorbing element using a heat transfer device. The method also may include transferring heat from the heat-conducting element to the anisotropic nanocomposite element using an interface placed between the heat-conducting element and the anisotropic nanocomposite element. The method may further include directing heat from the heat generating element toward the anisotropic nanocomposite element. Additionally, the method may include controlling transfer of heat from the heat-generating element based at least in part on the temperature of the heat-generating element.

The foregoing disclosure is directed to the certain exemplary embodiments and methods. Various modifications, however, will be apparent to those skilled in the art. It is intended that all such modifications shall be deemed within the scope of the appended claims and be embraced by the foregoing disclosure. Also, the abstract is provided to meet certain statutory requirements and is not to be used to limit the scope of the claims in ay manner.

What is claimed is:

1. An apparatus, comprising:

an anisotropic nanocomposite element configured to be placed in a downhole tool, the anisotropic nanocomposite element in thermal communication with a heat generating element for conducting heat away from the heat generating element along a selected direction, wherein the anisotropic nanocomposite element comprises a cable and includes thermally conductive nanoparticles embedded within a base material and aligned therein to form a heat conduit to conduct heat from a first end of the cable to a second end of the cable and wherein thermal conductivity in the selected direction is greater than thermal conductivity in a direction perpendicular to the selected direction, wherein the base material is configured to be in contact with the heat-generating element and a heat-absorbing element.

2. The apparatus of claim 1 further comprising the heat-absorbing element in thermal communication with the anisotropic nanocomposite element for receiving heat from the anisotropic nanocomposite element.

3. The apparatus of claim 2, wherein the heat-absorbing element is selected from a group consisting of a: (i) metallic member; (ii) ceramic member; (iii) laminate of (i) and (ii); (iv) metal and non-metal composite; (v) fluid; (vi) sorption cooler; and (vii) phase change device.

4. The apparatus of claim 2 further comprising an insulating element proximate to the heat-generating element for directing heat from the heat generating element toward the anisotropic nanocomposite element.

5. The apparatus of claim 1, wherein the anisotropic nanocomposite element comprises the base material and aligned thermally conductive nanotubes.

6. The apparatus of claim 5, wherein the nanotubes are composed of at least one of: (i) carbon; (ii) boron nitride; and (iii) gallium nitride.

7. The apparatus of claim 1, wherein the anisotropic nanocomposite element is made using a stack of sheets, each sheet containing the base material and aligned thermally conductive nanotubes.

8. The apparatus of claim 1 further comprising: a sensor for providing a measure of temperature of the heat-generating element.

9. A method for conveying heat away from a heat-generating element in a downhole tool, comprising:

transferring heat from the heat-generating element in the downhole tool to an anisotropic nanocomposite element comprising a cable that is configured to conduct heat along a selected direction from a first end of the cable to a second end of the cable; and transferring heat received by the anisotropic nanocomposite element to a heat absorbing element, wherein the anisotropic nanocomposite element includes thermally conductive nanoparticles embedded within a base material and aligned therein to form a heat conduit and wherein thermal conductivity in the selected direction is greater than thermal conductivity in a direction perpendicular to the selected direction, wherein the base material is configured to be in contact with the heat-generating element and a heat-absorbing element.

10. The method of claim 9, wherein the nanocomposite element comprises the base material and aligned thermally conductive nanotubes.

11. The method of claim 9 further comprising directing heat from the heat generating element toward the anisotropic nanocomposite element.

12. The method of claim 9, wherein the heat-absorbing element is selected from a group consisting of a: (i) metallic member; (ii) ceramic member; (iii) laminate of (i) and (ii); (iv) metal and non-metal composite; (v) fluid; (vi) sorption cooler; and (vii) phase change device.

13. A tool for use in a wellbore, comprising:

a tool body;

a heat-generating element in the tool body;

a heat conduction device that includes at least one anisotropic nanocomposite element coupled to the heat generating element for conducting heat away from the heat-generating element along a selected direction, wherein the anisotropic nanocomposite element comprises a cable and includes thermally conductive nanoparticles embedded within a base material and aligned therein to form a heat conduit to conduct heat from a first end of the cable to a second end of the cable and wherein thermal conductivity in the selected direction is greater than thermal conductivity in a direction perpendicular to the selected direction; and a heat absorbing element coupled to the heat conduction device for absorbing heat from the anisotropic nanocomposite element, wherein the heat-absorbing element and heat-generating element are in contact with the base material.

14. The tool of claim 13, wherein the anisotropic nanocomposite element includes the base material and highly aligned nanotubes disposed axially along the selected direction.

* * * * *